United States Patent [19]

Wier

[11] 4,393,554

[45] Jul. 19, 1983

[54] LOCKING DEVICE FOR SAFETY BELTS

[75] Inventor: Franz Wier, Göggingen, Fed. Rep. of Germany

[73] Assignee: Repa Feinstanzwerk GmbH, Alfdorf, Fed. Rep. of Germany

[21] Appl. No.: 237,922

[22] Filed: Feb. 25, 1981

[30] Foreign Application Priority Data

Feb. 25, 1980 [DE] Fed. Rep. of Germany ..... 3006972

[51] Int. Cl.[3] ..... A44B 11/26

[52] U.S. Cl. ..... 24/230 AL

[58] Field of Search ..... 24/230 A, 230 AL

[56] References Cited

U.S. PATENT DOCUMENTS 3,789,492 2/1974 Klink ..... 24/230 AL 4,197,619 4/1980 Burleigh ..... 24/230 AL

*Primary Examiner*—Hugh R. Chamblee

*Attorney, Agent, or Firm*—Herbert L. Lerner; Laurence A. Greenberg

[57] ABSTRACT

Locking device for a safety belt with a belt lock and a plug-in tongue fastened to the belt end. The tongue can be engaged with an engagement edge by at least one latch which is movable transversely to the plug-in direction of the plug-in tongue. The latch in the region of the engagement edge of the plug-in tongue has a profile which comes close to complementing the shape of the engagement edge as it changes under load.

3 Claims, 5 Drawing Figures

LOCKING DEVICE FOR SAFETY BELTS

BACKGROUND OF THE INVENTION

1. Field of the Invention

The invention relates to a locking device for a safety belt with a belt lock and a plug-in tongue fastened to the belt-end, whereby the tongue can be engaged with an engagement edge by at least one latch which is movable transversely to the plug-in direction of the plug-in tongue.

2. Description of the Prior Art

In the known locking devices of this type, in which either the plug-in tongue is provided with a detention opening into which the block-like latch falls when the tongue is plugged into the belt lock, or in which the plug-in tongue is made in a T-shape, and acts in conjunction with two latching elements which engage behind the free T-legs, the engagement edge of the tongue is essentially parallel to the locking edge of the latch working in conjunction with the tongue, so that the two edges butt against each other with their whole area when the safety system is not heavily loaded. However, in operation, particularly in case of a crash, i.e. if a very great pulling force acts on the belt end, and thereby on the plug-in tongue, one can, as a rule, detect a deformation of the originally straight engagement edge of the plug-in tongue, which is often connected with a slight oblique position of the plug-in tongue. The result of this deformation is that the mentioned edges do not contact each other with their full areas, but touch each other at one point, i.e. with very high stress on a small area, so that great shear forces are acting on the plug-in tongue, and can thereby nullify the safety function of the safety system.

SUMMARY OF THE INVENTION

An object of the present invention is to provide a locking device of the above-mentioned type which, in case of a crash, will assure whole-area contact of the engagement edges of plug-in tongue and latch.

With the foregoing and other objects in view, there is provided in accordance with the invention a locking device for a safety belt comprising a belt lock having two spaced plates defining an insertion path, a plug-in tongue attached to a belt for insertion in the insertion path, a latching bolt having an engagement surface movable transversely to the plug-in direction of the plug-in tongue to block withdrawal of the tongue by contact of said engagement surface with an edge surface of said plug-in tongue, said edge surface changing its shape upon the belt being subjected to a load and said engagement surface of said latch contoured to complement the shape of said edge surface under load to thereby provide increased contact area between said latching bolt and said plug-in tongue under load conditions.

Other features which are considered as characteristic for the invention are set forth in the appended claims.

Although the invention is illustrated and described herein as embodied in a locking device for safety belts, it is nevertheless not intended to be limited to the details shown, since various modifications may be made therein without departing from the spirit of the invention and within the scope and range of equivalents of the claims.

BRIEF DESCRIPTION OF THE DRAWINGS

The invention, however, together with additional objects and advantages thereof will be best understood from the following description when read in connection with the accompanying drawings, in which:

FIGS. 1 and 2 shown the relationship of the lock carrier with spaced plates to form an insertion path, a plug-in tongue inserted, a latch, and engagement surfaces between latch and tongue.

DETAILED DESCRIPTION OF THE INVENTION

Figure 1:
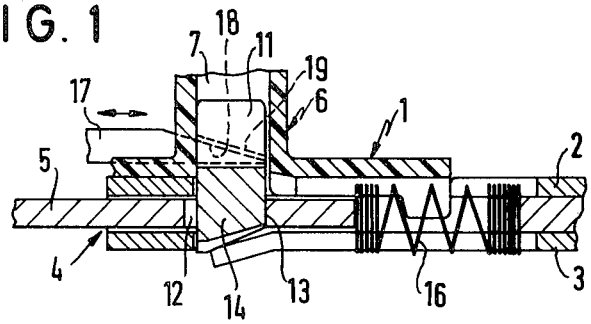
FIGS. 1 and 2 are schematic representations of the most important parts of the locking device according to the invention, in two different operating positions; locked in FIG. 1 and open in FIG. 2.

In accordance with the invention, the latch in the region of the engagement edges of the plug-in tongue has a profile which comes close to the shape of the engagement edge as it is changed under a load. By the virtue of the feature that the profile of the engagement surface or engagement edge of the latch is initially formed according to the expected deformation of the engagement edge of the plug-in tongue, during normal operation, in the mostly unloaded closed position of the belt lock, essentially only a point contact between tongue and latch exists. Such condition does not harm because of the insignificant pull-forces. However, in the case of a crash, i.e. when a strong pulling load occurs, the mentioned engagement edges or surfaces contact with a large area, so that the pulling force is uniformly distributed over a relatively large area. In this manner, the danger to the engagement elements of the plug-in tongue is eliminated.

According to a further embodiment of the invention, the latch has an arched or wedge-shaped profile. An arched profile for the latch is chosen if the plug-in tongue has a detention opening with a single, straight engagement edge, while if the tongue has a T-shape, the latching elements, which are arranged at both sides of the tongue, are preferably provided with wedge-shaped engagement edges or engagement surfaces which are spaced apart from each other.

Further advantageous features are shown in the typical embodiments shown in the drawings, and described in the following.

Figure 2:
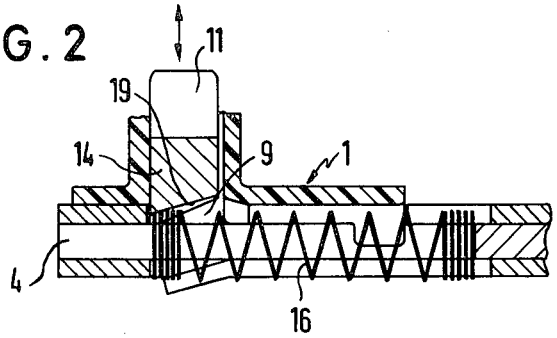

In the locking device according to FIGS. 1 and 2, the belt lock 1 consists primarily of a metallic lock carrier having two plates 2 and 3 which are spaced from each other and rigidly connected with each other, and which form the boundary for a plug-in guide 4 for a plug-in tongue 5. The lock carrier which is enclosed in a plastic housing 6 is connected at the floor of the vehicle equipped with the safety belt system, for example by means of a cable (pull rope), while the metallic tongue 5 is fastened to the loose end of a belt which can be rolled up by a conventional automatic roll-up device. A metallic latch 11, according to FIG. 2 slideable in the direction of the arrow, is guided in a slide 7 of the belt lock 1, which slide 7 is perpendicular to the plug-in guide 4, and formed by an opening 9 in the plate 2 and a similar opening in plate 3 in conjunction with vertical guide projection of the housing 6. In FIG. 1, the plug-in tongue 5 and the latch 11 are in the lock-or closed position, whereby the latch 11 engages in, for example, a rectangular or square detention opening 12 in the tongue 5, and contacts or hits a perpendicular engagement surface 13 at the latch-shaft 14 at an engagement edge of the detention opening 12. This engagement edge of tongue 5 is designated 15 in FIG. 4. The engagement edge 15 of the tongue 5 is pressed against the engagement surface 13 of the latch 11 by a spring element in the form of a spiral spring 16 which serves as an ejector. For opening the locking device, a schematically shown pressure element 17 provided with a handle, is moved in the direction of the arrow shown in FIG. 1, so that it moves with a slanted surface 18 up on an also slanted slide-surface 19 of the latch 11, whereby the latch as shown in FIG. 1 slides upward into the open-or unlatched position, according to FIG. 2. The bottom 19' of latch 11 is also slanted as seen from FIGS. 1 and 2.

Figure 3:
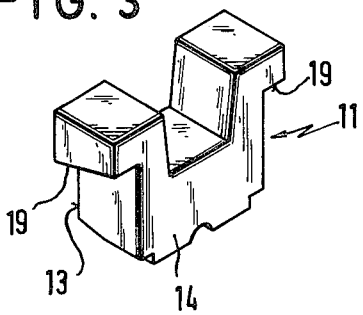
FIG. 3 is a perspective representation of the latch used in the embodiment according to FIGS. 1 and 2.
Figure 4:
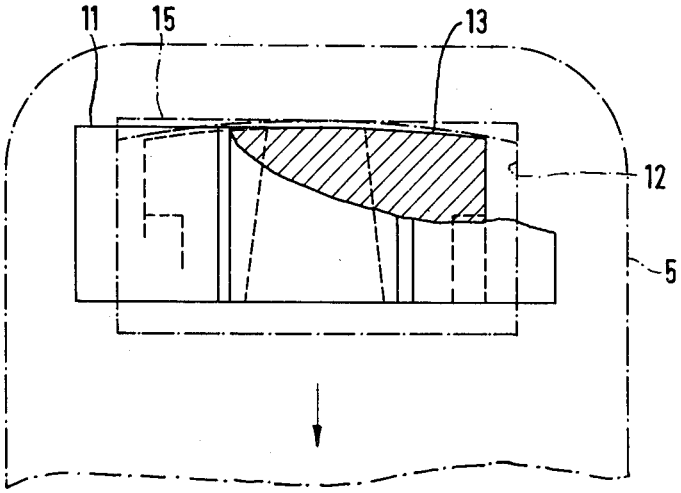
FIG. 4 is a plan view onto the latch according to FIG. 3 together with a plug-in tongue engaged therein.

The above-mentioned latch 11 is shown as detail in FIGS. 3 and 4. One can see that this latch is essentially T-shaped, and provided at its free legs with slanted sliding surfaces 19. As especially shown in FIG. 4, the engagement surface 13 of the latch 11 is in profile arched or rounded, while the engagement edge 15 of the detention opening 12 of the plug-in tongue 5 is straight. If in the case of a crash, a pulling force acts on the plug-in tongue 5, in the direction of the arrow in FIG. 4, the originally straight engagement edge 15 of the tongue 5 flexes, and takes the form of the arched profile of the engagement surface 13 of the latch 11, so that the pulling-force is distributed on the full area of the engaging surfaces. This applies also for the case wherein at the occurrence of the pulling force, the tongue 5 tilts or turns more or less slightly with respect to the latch 11. Here also a broad surface contact of the mentioned engagement surfaces is assured. In FIG. 4, the deformation of the engagement edge 15 in the case of a crash, is indicated by a curved dotted line.

Figure 5:
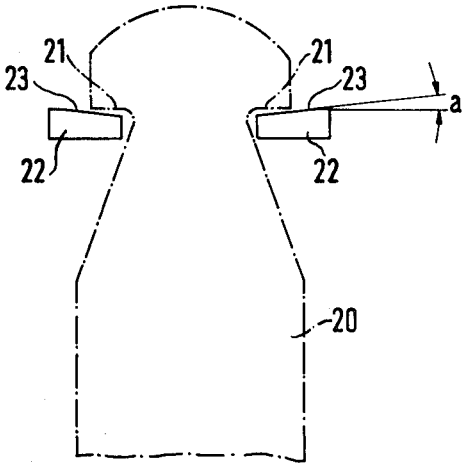
FIG. 5 is a schematic representation of a plug-in tongue and a differently designed latch.

In the embodiment according to FIG. 5, the push-in tongue 20, in contrast to the explained embodiment, is at its free end essentially T-shaped, and is provided with two straight engagement edges 21 which are spaced from each other and lie in one plane. Two latching elements 22 engage behind the two edges 21 after the tongue 20 has been plugged into a belt lock similar to the one shown in FIGS. 1 and 2. The latching elements 22 can be part of a single, essentially U-shaped latch, which can be operated in a similar manner as in the preceding embodiment. The engagement surfaces 23 of the latching elements 22 are wedge-like slanted with respect to each other about an angle a. In this manner, in the case of a crash, the easily deformed engagement edges 21 of the tongue 20 again lie with their full area at the engagement surfaces 23 of the latch, so that the pulling force is again uniformly distributed on a larger area.

Obviously here, as well as at the embodiment according to FIGS. 1 to 4, the explained profile forms may be given another shape.

I claim:

1. Locking device for a safety belt comprising a belt lock having two spaced plates defining an insertion path, a plug-in tongue attached to a belt for insertion in the insertion path, a latching bolt having an engagement surface movable transversely to the plug-in direction of the plug-in tongue to block withdrawal of the tongue by contact of said engagement surface with a straight edge surface of said plug-in tongue, said straight edge surface changing its shape upon the belt being subjected to a load and said engagement surface of said latch contoured to complement the shape of said edge surface under load to thereby provide increased contact area between said latching bolt and said plug-in tongue under load conditions.

2. Locking device according to claim 1, wherein the tongue has a detention opening with a single, straight engagement edge, and wherein the latch has an arched profile as the surface in contact with the edge surface of the plug-in tongue.

3. Locking device according to claim 1, wherein the tongue has a T-shape, and wherein the latch has two wedge-shaped profiles arranged at both sides of the tongues as the surfaces in contact with the edge surfaces of the plug-in tongue.

* * * * *